US009878884B1

(12) United States Patent
Ellis et al.

(10) Patent No.: US 9,878,884 B1
(45) Date of Patent: Jan. 30, 2018

(54) PULLEY SYSTEMS FOR HAULING OR LOWERING LOADS

(71) Applicant: INTERNATIONAL SAFETY COMPONENTS LTD, Bangor, Gwynedd (GB)

(72) Inventors: Wayne Ellis, Gwynedd (GB); Kevin Brown, Gwynedd (GB)

(73) Assignee: INTERNATIONAL SAFETY COMPONENTS LTD, Bangor, Gwynedd (GB)

( * ) Notice: Subject to any disclaimer, the term of this patent is extended or adjusted under 35 U.S.C. 154(b) by 0 days.

(21) Appl. No.: 15/359,970

(22) Filed: Nov. 23, 2016

(51) Int. Cl.

| | |
|---|---|
| ***B66D 3/10*** | (2006.01) |
| ***A62B 1/14*** | (2006.01) |
| ***B66C 1/36*** | (2006.01) |
| ***A63B 29/02*** | (2006.01) |

(52) U.S. Cl.
CPC ..... *B66C 1/36* (2013.01); *A62B 1/14* (2013.01); *A63B 29/028* (2013.01); *B66D 3/10* (2013.01)

(58) Field of Classification Search
CPC ..... A62B 1/14; A63B 29/02; A63B 29/028; A63B 29/08; B66D 3/10; B66C 1/36
USPC ..... 254/391; 294/82.11; 182/5, 133, 136; 188/65.1, 65.2
See application file for complete search history.

(56) References Cited

U.S. PATENT DOCUMENTS

| | | | | | |
|---|---|---|---|---|---|
| 5,348,117 | A * | 9/1994 | Pickering | A62B 1/14 | 182/236 |
| 5,538,223 | A * | 7/1996 | Scace | B63H 9/10 | 254/391 |
| 5,918,701 | A * | 7/1999 | Rogelja | B66D 3/10 | 182/234 |
| 5,927,438 | A * | 7/1999 | Ostrobrod | A62B 1/08 | 182/192 |
| 6,189,867 | B1 * | 2/2001 | O'Rourke | B66D 3/04 | 254/391 |
| 7,658,264 | B2 * | 2/2010 | Mauthner | A62B 1/14 | 182/5 |
| 9,120,654 | B2 * | 9/2015 | Chaumontet | A62B 1/10 | |
| 2008/0164096 | A1 * | 7/2008 | Rogelja | A63B 29/02 | 182/5 |
| 2014/0131157 | A1 * | 5/2014 | Chih | F16D 41/12 | 192/44 |

(Continued)

FOREIGN PATENT DOCUMENTS

| | | | |
|---|---|---|---|
| GB | 918785 | * | 2/1963 |

*Primary Examiner* — Dean J Kramer
(74) *Attorney, Agent, or Firm* — King & Schickli, PLLC

(57) ABSTRACT

A load-hauling device includes a pair of karabiners, each having an array of pulleys, a pulley rope fixed at one end to one of the karabiners below its respective pulley array, to anchor that end of the rope, the pulley rope passing sequentially between the pulleys of each pulley array to provide a mechanical advantage at the free end of the pulley rope when pulled, a rotatable locking cam mounted between a cam yoke fixed around an end pulley of one of the pulley arrays, wherein the cam includes a cam spring to bias the cam to engage with the rope and permit movement of the rope in one direction while preventing movement of the rope in the other direction, the cam including an integral trigger and locking mechanism to selectively disengage the cam from the rope and allow the device to release a load carried thereby.

4 Claims, 4 Drawing Sheets

(56) References Cited

U.S. PATENT DOCUMENTS

2014/0361564 A1* 12/2014 Huang ..... F16B 45/02
294/82.11
2015/0183624 A1* 7/2015 Maurice ..... B66D 3/02
254/399

* cited by examiner

PULLEY SYSTEMS FOR HAULING OR LOWERING LOADS

This invention relates to pulley systems of the type typically used in rescue situations to raise or lower e.g. victims of accidents, such as fallen mountaineers, trapped potholers or industrial employees working at height.

BACKGROUND OF THE INVENTION

It is well known that rope pulley systems are useful in providing a mechanical advantage for lifting or lowering a load, the magnitude of the mechanical advantage typically being a function of the number and/or diametric size of each pulley wheel so that relatively heavy loads can be lifted or lowered by a single person pulling or releasing by hand the pulley rope. Thus, a typical rescue pulley system can easily support the weight of an accident victim and the rescuer during the rescue operation, often with a mechanical advantage in terms of force applied to or released from the pulley rope of 5 or 6 to one.

Many pulley rescue systems are known which are particularly suitable for so called self-rescuing, such as is described in DE202013003344, although they are not usually suitable for e.g. accident victims who are unconscious or otherwise disabled. In such circumstances the pulley system has to cope with the combined weight of the rescuer and accident victim, who may be secured by a harness to a stretcher, leaving the rescuer with the task of single-handedly raising or lowering the victim from a secure position up to the fully extended limit of the pulley system, and thereafter repositioning the pulley system for the next phase of the rescue. This requires the rescuer to pull on the free end of the pulley rope in order to raise or lower the entire load carried by the pulley system, and then to reposition anchors such as 'rope grabs' sufficiently securely for the next phase of safely raising or lowering the combined load. In order to do this, the pulley system must be restrained from running in the opposite direction required of the rescuer, this usually being achieved by means of a one-way brake system permitting the pulley rope to travel in one direction only during the lifting stage of the rescue whilst permitting controlled decent of the combined load being carried by the pulley system, as required. Such rope braking and rope releasing mechanisms can be complicated to operate by the rescuer, more particularly when in extreme circumstances, such as in confined spaces or within complex steel structures.

The present invention is derived from the realisation that there is a need for a simpler system of engaging or disengaging, as the case may be, the pulley rope brake from the pulley system.

SUMMARY OF THE INVENTION

According to the invention there is provided a load-hauling device comprising or including, a pair of karabiners, each karabiner having an array of pulleys, a pulley rope fixed at one end to one of the karabiners via a becket eye below its respective pulley array, to anchor that end of the rope to the becket eye, the pulley rope passing sequentially between the pulleys of each pulley array to provide a mechanical advantage at the free end of the pulley rope when the pulley rope is pulled by a user of the device, a rotatable locking cam mounted between a cam yoke fixed around an end pulley of one of the pulley arrays, wherein the cam includes a cam spring to bias the cam to engage with the rope and permit movement of the rope in one direction while preventing movement of the rope in the other direction, the cam including an integral trigger and associated trigger locking mechanism whereby to selectively disengage the cam from the rope and allow the device to release a load carried thereby.

With this arrangement, the spring-biased locking cam assures the rescuer that unless it is released via the trigger it will always prevent unwanted movement of the rope and hence the load being carried by the second karabiner, whilst permitting the rescuer, normally attached to the first karabiner, to selectively operate the locking cam to engage or disengage with the pulley rope for the purposes of e.g. raising or lowering the load.

Conveniently, the locking cam trigger includes a spring-loaded projection, such as a detente ball, at the base of the trigger, the projection being partially engageable with a recess in the cam yoke whereby to temporarily disengage the locking cam from the rope against the bias of the cam spring. This permits the rescuer to easily engage or disengage the locking cam from the rope by simple finger pressure on the trigger, which is biased for safety to a closed position.

Preferably, the locking cam includes a stop member engageable with a formation on or in the cam yoke whereby to prevent over-rotation of the cam when disengaged from the rope. This arrangement ensures that the rotational movement of the locking cam is limited such that potentially catastrophic over-rotation, leading to the braking function of the cam effectively being disabled, cannot occur.

The rope-engaging locking cam preferably includes teeth, such as pointed teeth, with which to engage the pulley rope whereby to substantially prevent unwanted movement of the rope.

BRIEF DESCRIPTION OF THE DRAWINGS

The invention will now be described, by way of example only, with reference to the accompanying drawings in which.

DETAILED DESCRIPTION OF THE DRAWINGS

Figure 1:
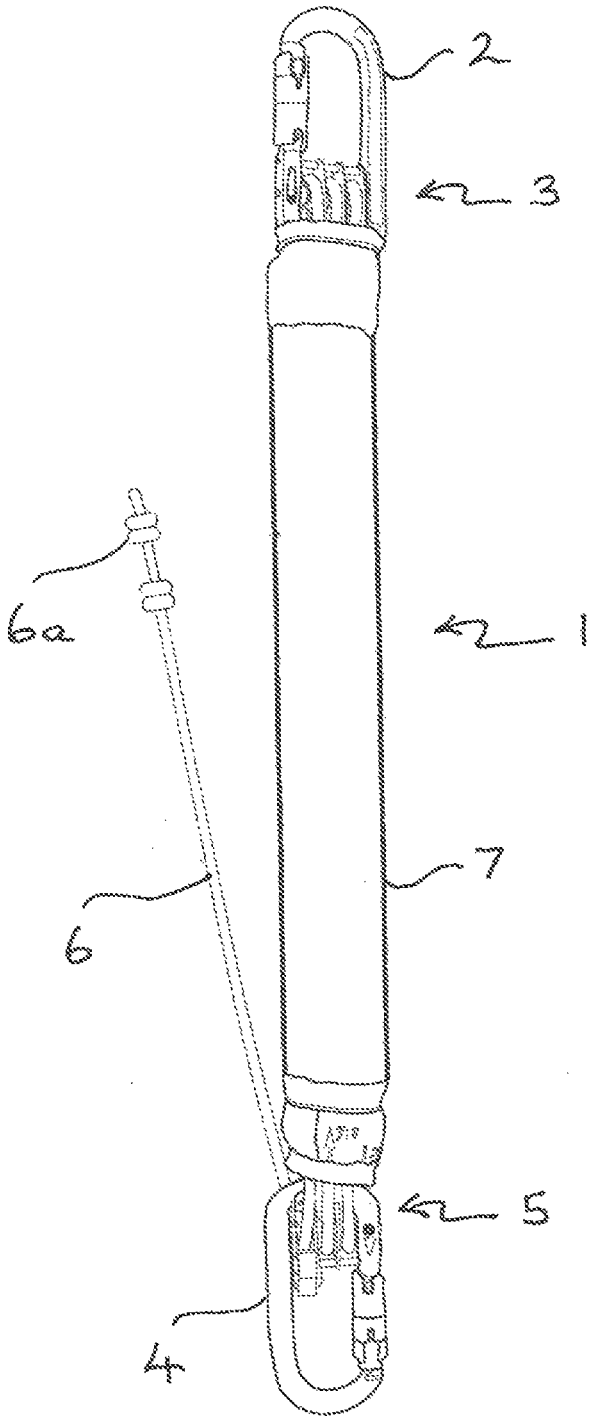
FIG. 1 is a side view of a load-hauling device of the invention.

Referring firstly to FIG. 1 there is shown a load-hauling device 1 which includes a first karabiner 2 and associated rope-pully array 3, a second karabiner 4 and associated rope pulley array 5, the pulley arrays 3, 5 being linked by a single pulley rope 6 which is largely protected against chafing against e.g. rock surfaces, or otherwise becoming entangled, by virtue of a flexible pulley rope sheath 7 of fine mesh extending between the first and second karabiners 2, 4.

The arrangement thus far described is generally conventional and when the first karabiner 2 is fixed to an anchor point, a load attached to the second karabiner 4 can be lifted by the simple expedient of pulling the free end 6*a* of the pulley rope 6, such as by the arm of a mountain rescuer. The second karabiner 4 and associated load can therefor be raised towards the first karabiner 2 by incremental movements of the pulley rope 6 which utilises the mechanical advantage of the pulley system, which may typically be between five or six to one in terms of the distance travelled by the pulley rope 6 and the distance travelled by the load being hauled.

Figure 2:
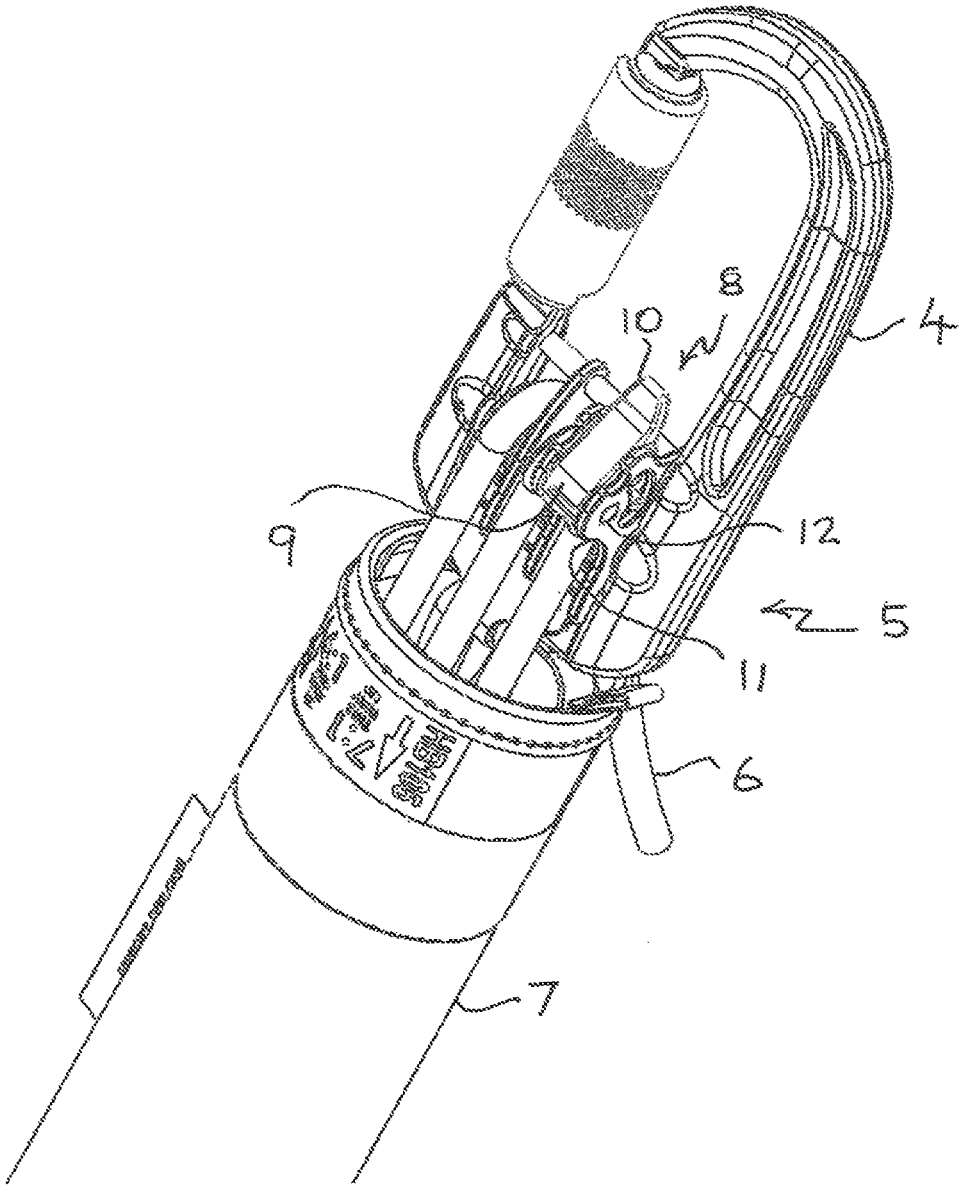
FIG. 2 is a detailed view of part of the load-hauling device of FIG. 1 in its load-hauling condition.

FIG. 2 shows an enlarged view of the second karabiner 4 and associated pulley array 5. The pulley array 5 is composed of three pulleys, of which the latter is the final one for discharging the pulley rope 6 and includes a brake mechanism shown generally at 8 comprising a locking cam 9 and operating trigger 10 rotationally fixed between a cam yoke 11 via a cam spindle 12. The locking cam 9 has pulley rope-engaging teeth (not shown) with which to grip and arrest movement of the rope in an unintended direction. In the position shown, the cam trigger 10 is at its lowermost position, representing engagement of the locking cam 9 with the pulley rope 6, but can be moved from that position via anticlockwise rotation of the trigger 10 for disengagement with the pulley rope.

Figure 3:
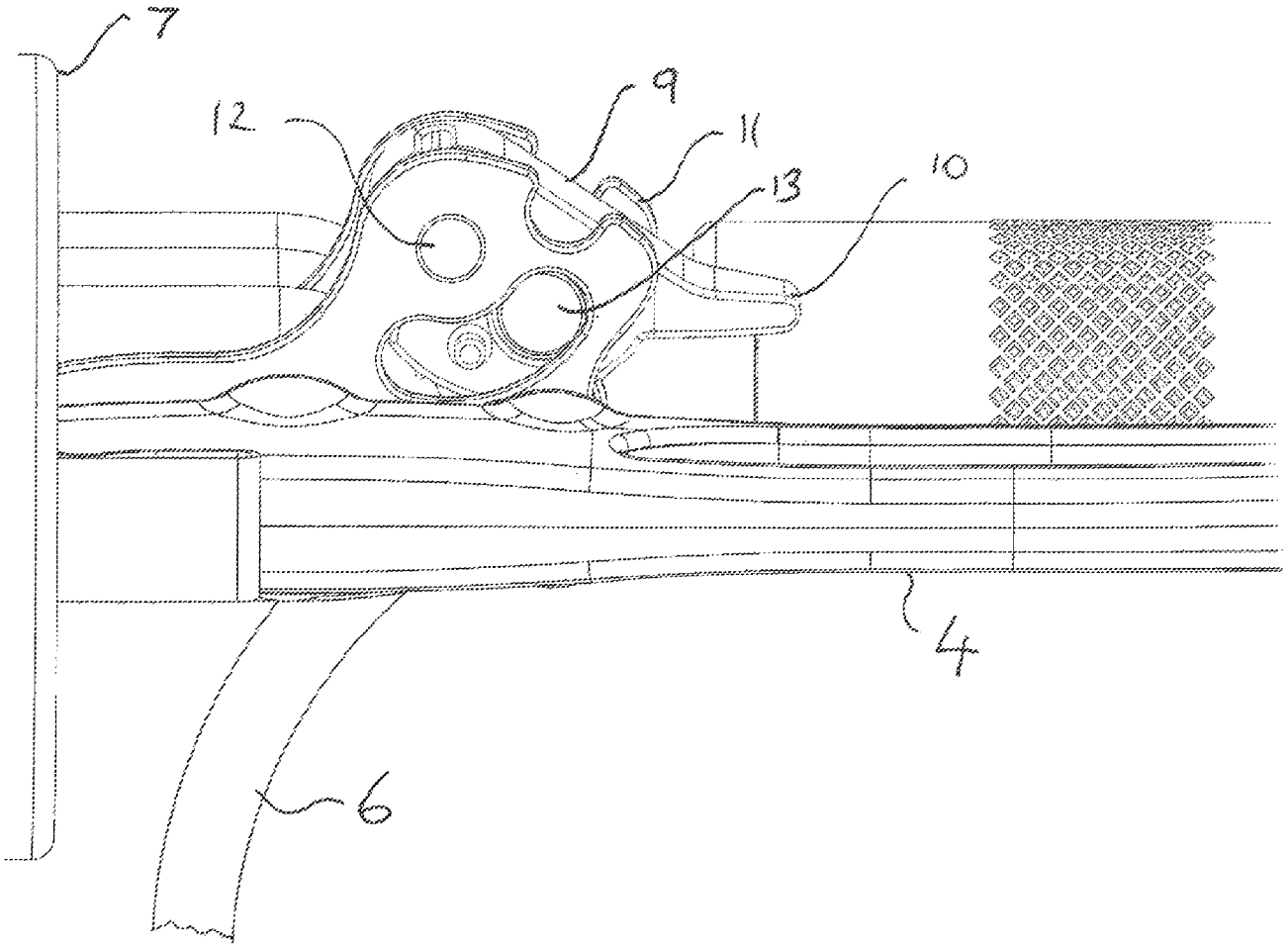
FIG. 3 is a detailed view of part of load-hauling device of FIG. 1 in its load-hauling condition.
Figure 4:
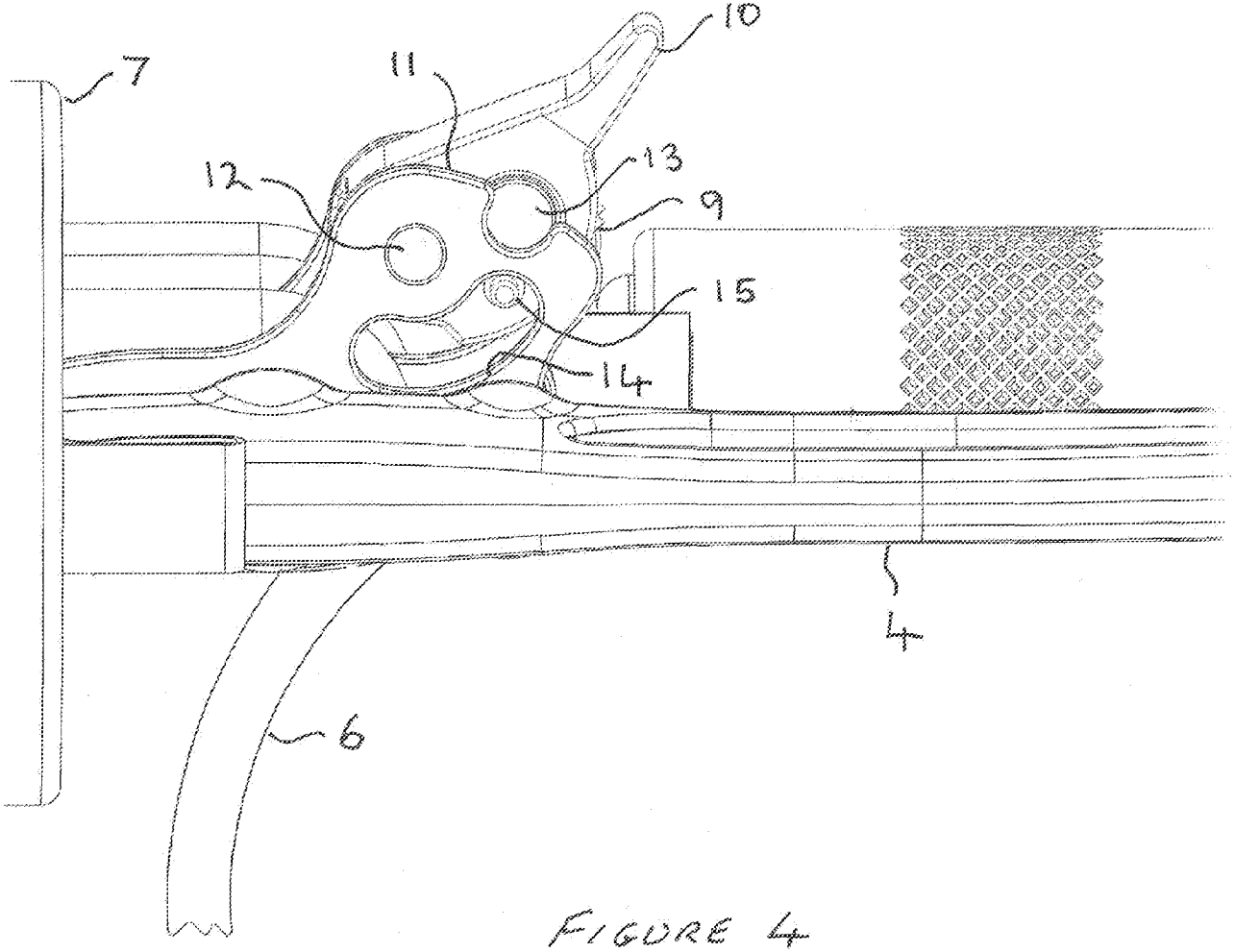
FIG. 4 is a detailed view of the load-hauling device of FIG. 1 in its load-releasing condition.

FIG. 3 shows part of the arrangement of FIG. 2 in more detail in which it will be seen that the locking cam trigger 10 is in its closed position corresponding to the locking cam 9 engaging with the pulley rope 6 to thereby only permit uni-directional movement thereof. In this condition the load hauling device 1 can only pull objects, but in the condition shown in FIG. 4, where the trigger 10 and hence locking cam 9 are in their raised position the latter is temporarily disengaged from the rope 6, thereby allowing movement of the rope 6 in either direction without any automatic braking facility. This can be achieved by means of a projection in the form of a spring-loaded detente ball 13 or other such temporary locking mechanism, which engages within an arcuate slot 14 in one side of the cam yoke 11, and is released by clockwise rotation of the trigger 10 in order to return the locking cam 9 to the position shown in FIG. 3. Over-rotation of the cam 9 in the anti-clockwise direction is prevented by means of a stop-member 15 received within the arcuate slot 14 in the side of the yoke 11, thereby ensuring that the cam 9 remains in a position where it can be quickly switched back to engage with the rope when required.

The invention therefore provides an elegantly simple mechanism for controlling by finger-pressure only the operation of a rope pulley system in which the cam mechanism 8 is biased towards the rope 6 but can be easily released as required.

The invention claimed is:

1. A load-hauling device comprising, a pair of karabiners, each karabiner having an array of pulleys, a pulley rope fixed at one end to one of the karabiners below its respective pulley array, to anchor that end of the pulley rope, the pulley rope passing sequentially between the pulleys of each pulley array to provide a mechanical advantage at the free end of the pulley rope when the pulley rope is pulled by a user of the device, a rotatable locking cam mounted between a cam yoke fixed around an end pulley of one of the pulley arrays, wherein the locking cam is biased to engage with the pulley rope and permit movement of the pulley rope in one direction while preventing movement of the pulley rope in the other direction; and a cam trigger which includes a spring-loaded locking projection at the base of the trigger, the locking projection being partially engageable with a recess in the cam yoke whereby to disengage the cam from the pulley rope.

2. The device according to claim 1 further characterised in that the locking cam includes a stop member engageable with a formation on or in the cam yoke whereby to prevent over-rotation of the cam when disengaged from the rope.

3. The device according to claim 1 wherein the locking cam includes rope-engaging teeth operable to substantially prevent rearward movement of the rope behind the cam.

4. The device according to claim 1, wherein the locking projection comprises a detente ball.

* * * * *